US008414211B1

(12) United States Patent
Lindelof et al.

(10) Patent No.: US 8,414,211 B1
(45) Date of Patent: Apr. 9, 2013

(54) PROTECTED PRONG FILE FASTENER

(75) Inventors: Harold Peter Lindelof, Eden Prairie, MN (US); Marvin J. Halfen, Hastings, MN (US); David J. Gilbertson, Hastings, MN (US); Robert Scudder, Rancho Cucamonga, CA (US); Michael Goodson, Rancho Cucamonga, CA (US); Michael Hacker, Rancho Cucamonga, CA (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 13/293,422

(22) Filed: Nov. 10, 2011

Related U.S. Application Data

(60) Provisional application No. 61/411,982, filed on Nov. 10, 2010.

(51) Int. Cl.

| | |
|---|---|
| ***B42F 3/00*** | (2006.01) |
| ***B42F 13/02*** | (2006.01) |
| ***B42F 13/06*** | (2006.01) |
| ***B42F 13/08*** | (2006.01) |

(52) U.S. Cl. ..... 402/14; 402/15; 402/18

(58) Field of Classification Search ..... 412/8, 14, 412/15, 18; 402/8, 14, 15, 18
See application file for complete search history.

(56) References Cited

U.S. PATENT DOCUMENTS

| | | | | |
|---|---|---|---|---|
| 3,896,528 | A | 7/1975 | Abeles | |
| 4,269,530 | A | 5/1981 | Weber | |
| 4,285,104 | A * | 8/1981 | Corey et al. | 402/14 |
| 4,437,781 | A | 3/1984 | Weihe et al. | |
| 4,519,504 | A | 5/1985 | Nausedas | |
| 4,869,613 | A | 9/1989 | Corey | |
| 5,037,228 | A | 8/1991 | Karlin | |
| 5,096,323 | A | 3/1992 | Walker | |
| 5,213,429 | A | 5/1993 | Johnson | |
| 5,236,226 | A | 8/1993 | Sheffield | |
| 5,257,870 | A | 11/1993 | Bennett et al. | |
| 5,593,242 | A | 1/1997 | Mathias | |
| 5,641,234 | A * | 6/1997 | Blumberg | 402/14 |
| 5,785,444 | A | 7/1998 | Matsuura | |
| 5,862,579 | A | 1/1999 | Blumberg | |
| 6,168,337 | B1 | 1/2001 | Adams | |
| 6,565,277 | B1 | 5/2003 | Huang | |
| 7,234,886 | B2 * | 6/2007 | Tuozzo | 402/14 |

* cited by examiner

*Primary Examiner* — Dana Ross
*Assistant Examiner* — Kyle Grabowski
(74) *Attorney, Agent, or Firm* — Altera Law Group, LLC

(57) ABSTRACT

A prong style file fastener, and method of manufacturer, is disclosed which has a protective element to prevent damage to paper documents and personal injury. In one embodiment, the prongs of the fastener is covered with a heat shrinkable sheath. In another, the prongs are overcoated with a powder coating which is melted thereon.

5 Claims, 9 Drawing Sheets

PROTECTED PRONG FILE FASTENER

BACKGROUND

1. Field of the Disclosure

The present invention is directed to the field of paper document management, and more particularly to file fasteners having bendable prongs.

2. Description of the Related Art

Paper fasteners have been used for decades to bind paper documents into file folders. They are typically formed from a base plate with two orthogonal prongs extending from the ends of the base plate and which are themselves bendable.

In the most prevalent configuration, the fastener also includes a compressor plate which is used at the end of the prongs to provide a secure lock on the prongs.

These prior art devices have at least two serious deficiencies. First, they have sharp metal edges which shear the papers they are intended to bind and second, these same sharp edges can cause injuries.

A solution to these problems would be to dull or roll (coin) the edges. This does not seem to work at least with respect to the first problem. The mere nature of metal edges, dull or not, causes papers to become detached by ripping or shearing. Use of plastic prongs has likewise not worked well. The plastic is either too elastic or too rigid which causes cracks and failures.

The present invention provides multiple solutions to this dilemma.

BRIEF SUMMARY

A protected pronged file fastener is disclosed having a longitudinal base element having first and second ends, a pair of prongs each extending from each end of the base element, said prongs being bendably attached thereto, and a non-metallic sheath overcoating covering a substantial portion of each prong.

The fastener may also has a sheath of flexible tubular member heat shrunk on the prongs.

The fastener may also have prongs and tips, the prongs being tapered from the tip to a point between the tip and the end connect to the base.

The fastener may also have prongs that include a tip and are tapered from the tip to the base.

There is also a protected pronged file fastener having a longitudinal base element having first and second ends; a pair of prongs one each extending from each end of the base element, said prongs being bendably attached thereto, and a non-metallic sheath powder coating melted on a substantial portion of each prong.

The summary provided is intended to help the reader understand some aspects of the invention. The scope of the invention is defined by the claims as read with the specification and cannot be determined by this summary.

DETAILED DESCRIPTION OF THE INVENTION

Pronged fasteners are used primarily to attach documents into folders. They provide the advantage over ringed binders in that they are very compact and can adapt to varying thicknesses of documents and remain compact.

An early example of such a binder is found in U.S. Pat. No. 1,978,569 to Dayton dating back to 1934. For 75+ years, this has remained the dominate form of prong binder such as shown in the commercial product. Modifications of the concept such as U.S. Pat. No. 2,477,417 to Pitt worked with the compressor concept but the basic metal base two prong bendable binder is still the standard of the industry today. Even in 1992, patents were being granted on variations of the same product which suffers from the same defects as the original product (see U.S. Pat. No. 096,323 to Walker).

All of the prior devices suffer from two severe defects. First, they have sharp metal edges which shear the papers they are intended to bind and second, these same sharp edges can cause injuries. Thus, there has been a long felt need to solve both of these problems in an economical way, without losing the functionality of the prior art devices. Despite decades of attempts to develop a suitable alternative which was economically feasible, until now, the solution has eluded the efforts of others.

The present invention solves both of the above mentioned problems as well as an additional problem (metal fatigue from repeated bending of metal tangs), while maintaining a cost effective solution.

In one embodiment the as shown in FIGS. 1, 2, 3A, 3B, 4, 5, 6 and 7, a two prong binder 10 is shown. The version shown is a "bonded" type, meaning it is self contained and can be affixed to a file folder without punching the folder. The bonding feature is known in the art such as in Smead® Manufacturing Company product part number 24600. It is also possible to use the inventive features herein with other mechanisms for attachment to files, but as punching holes for the prongs to pass and riveting the base. (Smead® product 35511 or 11537, all of the named product being hereby incorporated by reference.)

Figure 7:
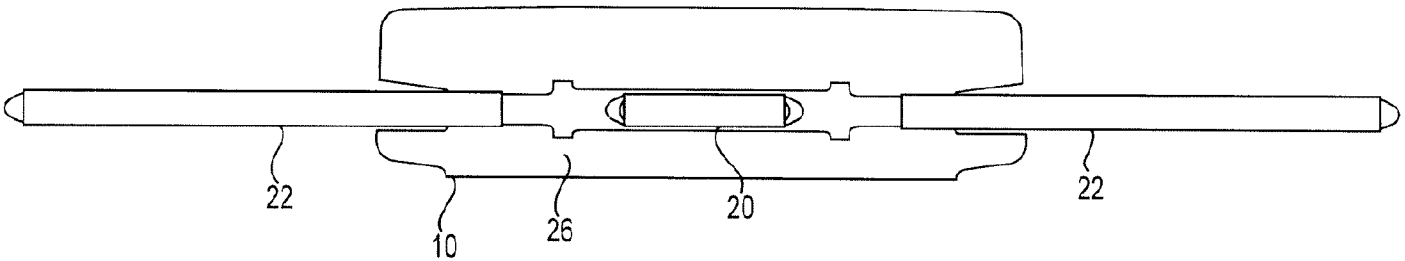
FIG. 7 is top plan view of the system in FIG. 4.

As seen most clearly in FIG. 7, binder 10 has a longitudinal base section 20, with bendable prongs 22 extending from both ends thereof. In this embodiment, the base is affixed to an fixation base 26 of fiber material which itself is then bonded to a file folder or the like, by adhesive.

Figure 1:
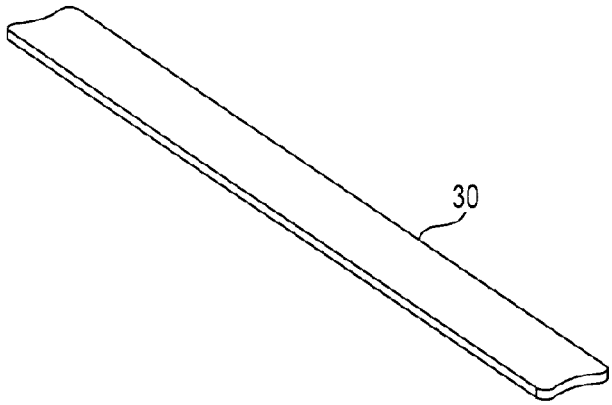
FIG. 1 illustrates a perspective view of a sheath.
Figure 2:
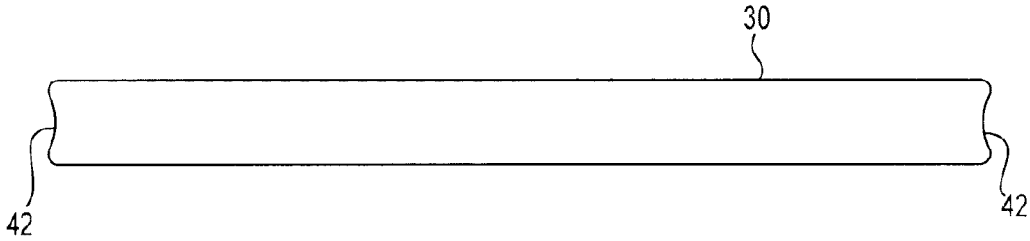
FIG. 2 is a plan view of the sheath in FIG. 1.

In this embodiment, the tang 22 is overcoated by a flexible material 30 which is shown alone in FIGS. 1 and 2. The preferred material is a heated shrinkable tubing of a type known in the art for electrical insulating applications such as 3M part IMCSN medium wall heat shrink tubing or similar products from Thermafix® product sold at www.shrinkshop.com. Such product typically have a 2:1 heat shrink ratio though other ratios may be acceptable.

Heat shrink tubing does not come flat as shown, but is supplied in a tubular format typically on long spools. The product is semi-rigid but not so rigid that it is easily inserted onto prong/tang 22 of the clasps 10. The method of manufacture which also forms a portion of this invention is detailed below.

To achieve the goals, of 1) safety against injury by laceration, 2) avoiding shearing of documents at their punch holes 3) metal fatigue caused by multiple bends to the metal tang and 4) creating wavy tangs from multiple bends in different places along its length as the document stack changes, by overcoating the tang with flexible non-shearing/cutting material, each of these problems is eliminated.

In particular, the tang 22 is fitted with a heat shrinkable sheath portion 30 which is then shrunk to engage the tang such that it cannot be removed. At the same time, the sheath protects both the user and the paper from cuts by occluding the sharp edges of the tang. Likewise, the bending radius of the tang is now reduced by virtue of the triple layered constructions (metal bounded by two layers of sheath). This prevents the tangs from kinking (becoming wavy and difficult for punched document papers to be inserted) and breaking from over bending. The increased bending radius is particularly helpful in avoiding damage to punched holes as there are no sharp bends in the tang at the point of contact with the paper at its weakest point (holes).

The prior art construction of the tang is not preferred for this new system. In the prior art, the tang has parallel sidewalls to its tip. In the preferred embodiment, the sidewalls 22*a-b* (see FIG. 6) are tapered so that they can accommodate insertion of the sheath 30 without snagging. This becomes important in high speed manufacturing because the sheath is not highly rigid, and if of low quality will not be perfectly cylindrical.

Figure 5:
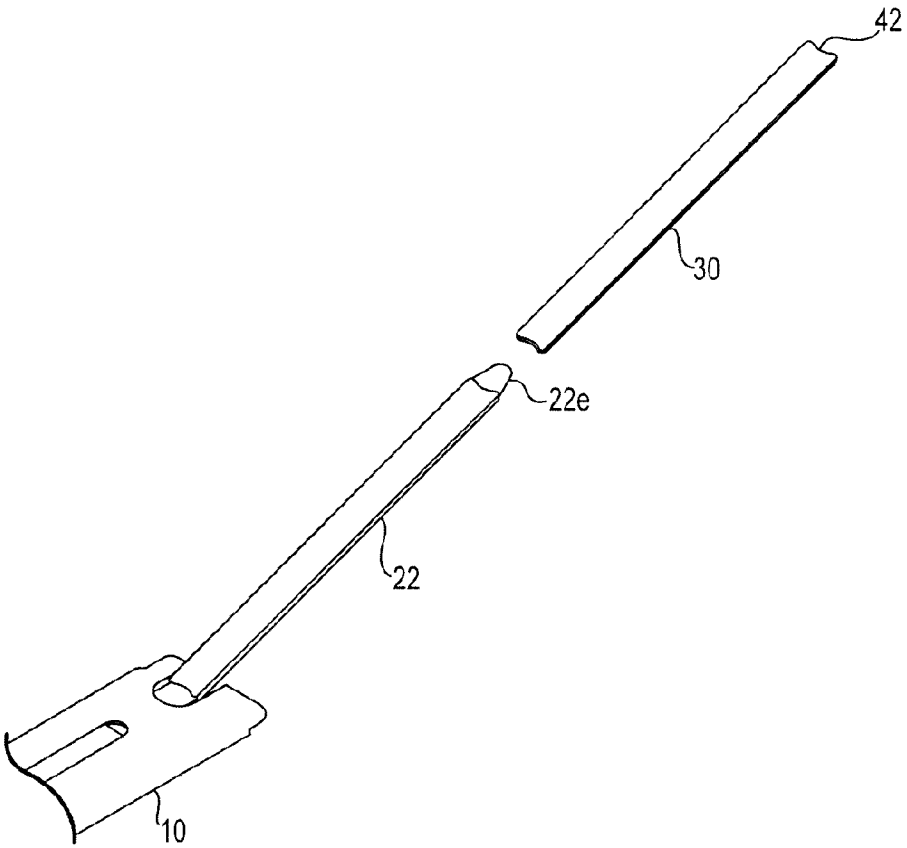
FIG. 5 is a fragmentary view of FIG. 4 with the sheath shown inserted and before insertion with a broad tip.
Figure 6:
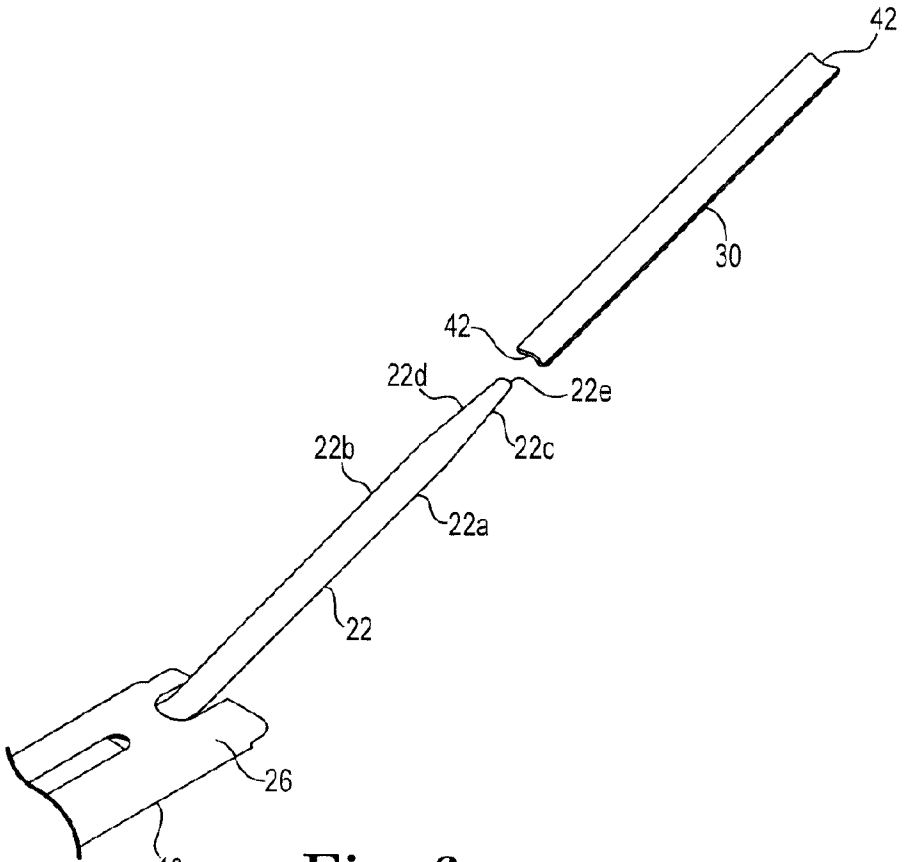
FIG. 6 is a view like FIG. 5 with the sheath before insertion with a narrow tip.

The tip in FIG. 5 is tapered, but in FIG. 6. is highly tapered for the same reasons as the body 22*a-b* is tapered. The taper 22*c-d* is more highly taped than the body 22*a-b*. This allows for easy insertion of the sheath, but does not result in an overly thin tang body which would degrade performance.

Figure 3A:
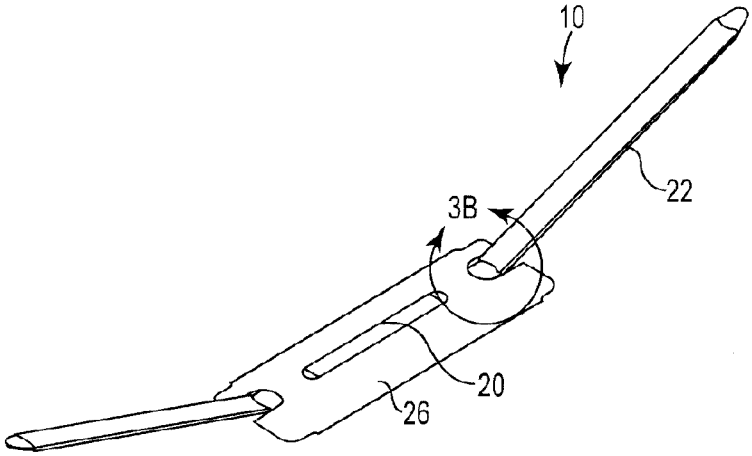
FIG. 3A is a perspective view of a prong clasp system according to one embodiment.
Figure 3B:
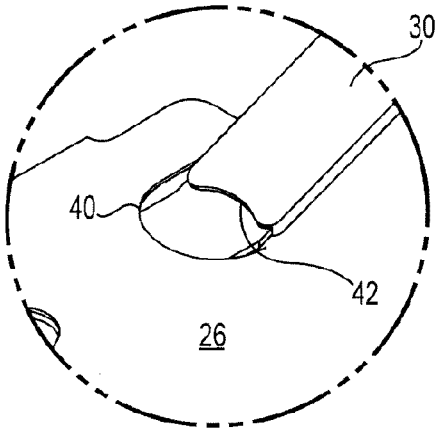
FIG. 3B is a close up fragmentary view of a portion of FIG. 3A.
Figure 4:
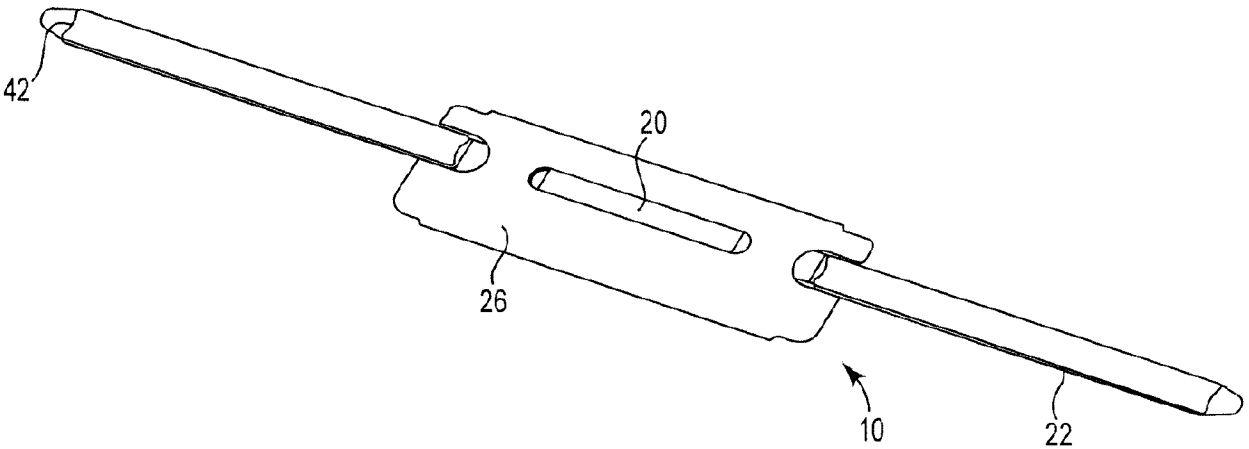
FIG. 4 is a perspective view of a clasp system.

The preferred terminations for the sheath 30 are as follows (see FIG. 3B: For the tip/distal end, the heat shrinkable sheath should terminate at a point on the top 22*e* where the total width (underlying base material+thickness of the sheath) is at least 10% less than the maximum width of the tang overcoated with heat shrinkable sheath/tubing. Alternatives would be 15%, 20%, 25% or more. The goal is to avoid snagging of the tip. By increasing the taper, the overcoating is less likely to snag. If the sheath 30 extends into the hole, the snagging risk is virtually eliminated.

At the proximal end the overcoating should preferably extend to contact or at least be adjacent to the base material 26 so that papers will not snag on their removal. The preferred extent would be close enough to the base that no single leaf of paper can fit therebetween.

When the heat shrinkable tubing is cut from a continuous spool, it can be simply cut orthogonally, or with a slight concavity 42. This can provide further resistance to snagging especially at the tip because the cut away portion (concavity) might otherwise cause slight bunching when shrinking.

Figure 8:
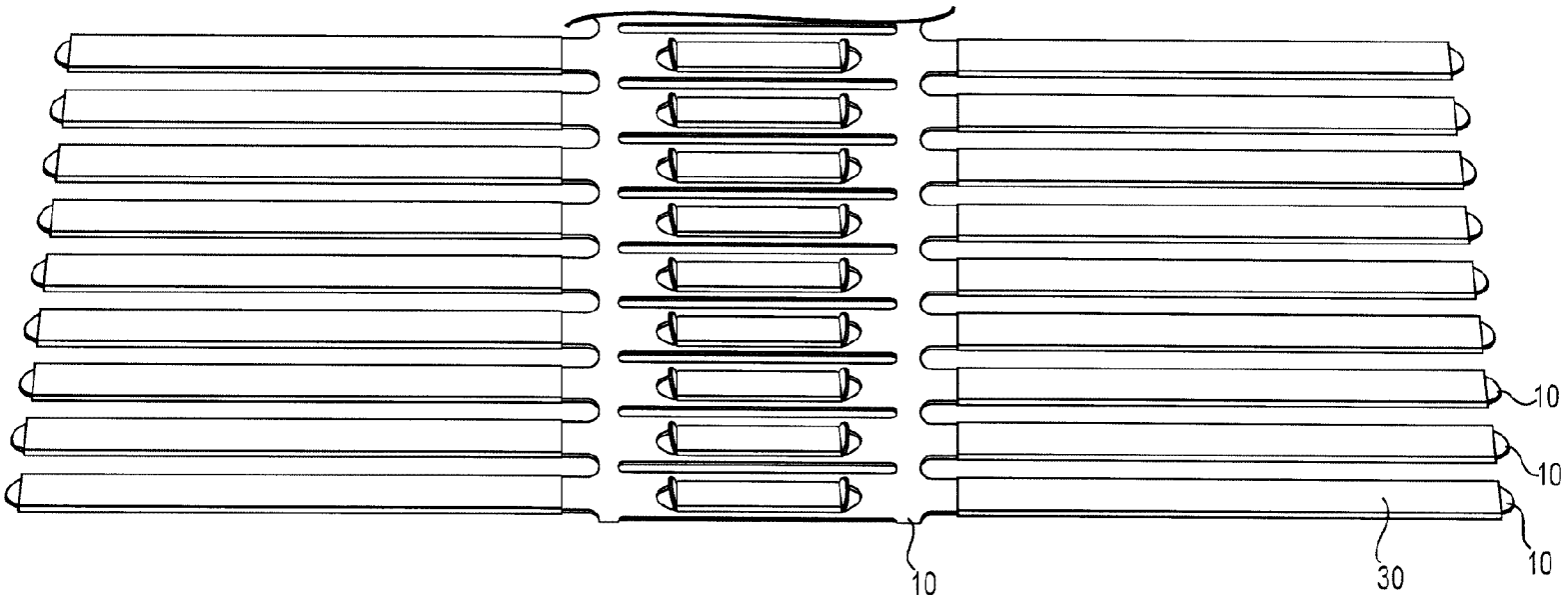
FIG. 8 is a perspective view of a plurality of prong clasps before cutting into separate clasps.

FIG. 8 illustrates a plurality of clasps 10 connected in a serial strip as produced by a punching machine. It is preferable to produce claps 10 in a continuous strip in order that they can be fitted with a sheath by automated machines.

There are multiple complications with the manufacture of sheath protected tangs. First, is the fact that the sheath material must be relatively thin to allow the increased width of the tang which the sheath creates and the fixed size of the standard hole punch. The international standard hole diameter is 5.5-6.5 mm (¼ inch) spaced 70 mm apart.

Final assembly onto base material 26 and then applying on to a file folder can be done by methods well known in the art of clasps not having this protective sheath.

Divider Embodiment

The sheath solution is less preferred for the special configuration used where a folder has an internal divider section which also has pronged clasped. Such a divider is shown at www.smead.com as item 68025.

Internal divider sections are located between two outer covers (often with pronged clasps each). They are often called classification folders. While it is possible to use the sheath covered solution above, it is known to provide a clasp structure which straddles the top of the divider section as shown in FIGS. 8*c*-8*d*.

These differ from the claps shown in FIGS. 1-7 in that they are intended for divider boards which are inserted between front and back covers. As dividers, they have double sided clasps (four tangs per unit attached to the divider, one pair for each side of the divider board). Consequently, it is somewhat more difficult to use the sleeve solution in FIGS. 1-8 because the clasps are closer together, often the pairs of tangs are of different lengths and there is a bend that must be formed in the assembly for crimping to the board. For this reason the preferred overcoating is by application of a powered material which is melted onto the tangs.

Figure 8A:
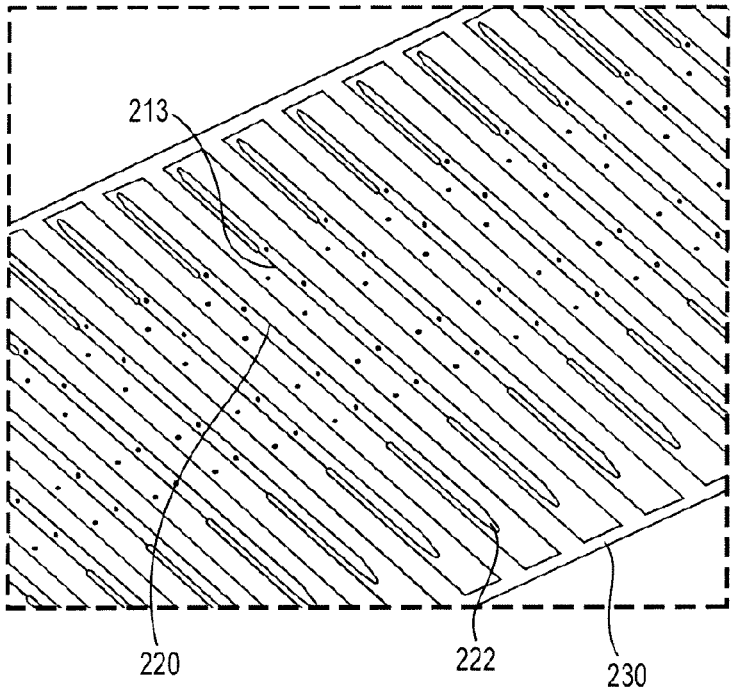
FIG. 8*a* is a perspective view of the plurality of divider style prong clasps in FIG. 8 illustrates.
Figure 8B:
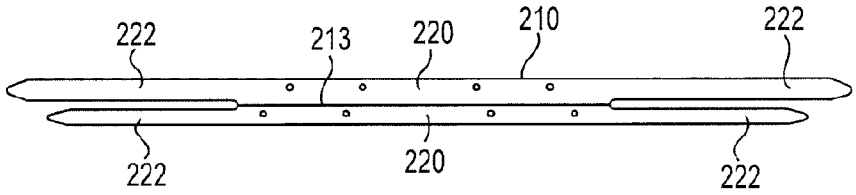
FIG. 8*b* is a top plan view of a single divider style prong clasp in FIG. 8*a*.
Figure 8C:
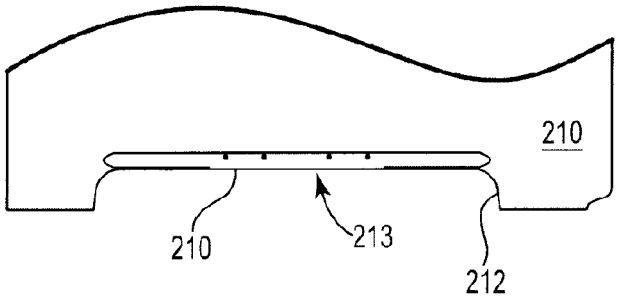
FIG. 8*c* a fragmentary plan view of a divider style prong clasp of FIG. 8*b* installed on one side of a divider.
Figure 8D:
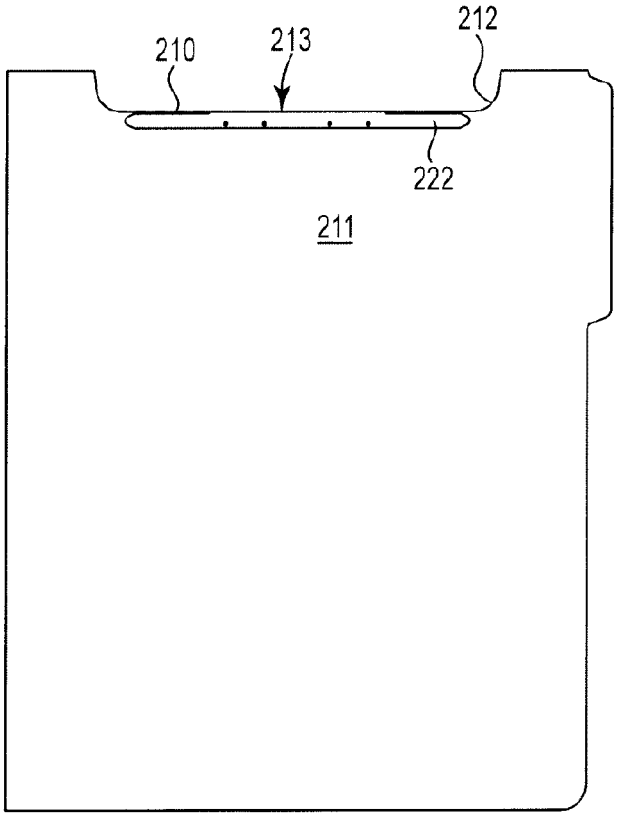
FIG. 8*d* is the other side of the divider shown in FIG. 8*c* shown in full view.

The divider 211 has two sides (FIG. 8*c* is a partial mirror image of FIG. 8*d*). A recess is cut into the divider panel 211 such that the tangs 222 will be positioned appropriately for documents. Note: the clasp 210 straddles both sides of the divider by means of a link portion 213 between front and rear sides. FIGS. 8*a* and 8*b* also show these features.

FIG. 8*a* illustrates how a plurality of clasps 210 are chained together into a single spool.

In order to solve the problems of the prior art clasps as mentioned above, the framing connectors 230 (FIG. 8*a*) needed to maintain the clasps on a roll. The connectors 230 will be cut out later.

The solution of the present invention in this embodiment is to overcoat the tangs and preferably the base section 220 with a protective coating which will remove all sharp edges and insure that the bending radius is increased, which will prevent kinking and metal fatigue.

In preparation for power coating, it is desirable to bend the two clasps at their straddle point 213 so that the clasps are orthogonal to each other. This is shown is FIG. 8*a*. If they are pre-bent 90 degrees, the flex required to bent a full 180 degrees (for attachment to the folder) will create less stress on the powder coat and it will be less likely to crack or flake off.

The pre-bending however creates difficulties in powder coating all of the prongs (there are typically 4 per unit), The powder coating is done electrostatically as well known in the art. The tangs 222, at a minimum are power coated and heat treated to melt the power into a continuous protect shield or coating around the sharp edges of the tangs. This gives them a rounded or radiussed edges that are both less likely to tear the paper at its holes and be safer for the user. Radiussing means that the sharp edges of the underlying tang material, usually metal) is coated with the plastic-like melted power coat which, because of its properties, including cohesion, creates curved or radiussed corners overcoating sharp corners.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A protected pronged file fastener having an enlarged bending radius to prevent kinking and tearing comprising:

a. a longitudinal fixation base having first and second ends, and an overlying cover;

b. a pair of prongs extending outwardly from each end of the base, a portion of the prongs being covered by said cover and the remainder of the prongs being bendable and wherein said prongs include a tip and are tapered from the tip to a point between the tip and the end connected to the base;

c. a non-metallic sheath overcoating covering a substantial portion of each prong, said sheath being a tubular member shrinkably engaged onto said prongs and extending from a point proximate said tip and to said base and at least a portion thereof extending under said cover;

d. wherein said prongs include a second taper from where the sheath ends and the tip is exposed, said second taper being greater than the first taper; and e. wherein the sheath, at least at its distal end, terminates with a concave end.

2. The fastener of claim 1 wherein sheath is a flexible tubular member is heat shrunk on said prongs.

3. The fastener of claim 1 wherein said prongs are increasingly tapered toward the tip.

4. The fastener of claim 1 wherein the sheath, at its distal end, terminates just before the base element.

5. A protected pronged file fastener having an enlarged bending radius to prevent kinking and tearing comprising:

a. a longitudinal fixation base having first and second ends, and an overlying cover;

b. a pair of prongs one each extending from the base and extending outwardly from each end of the base, a portion of the prongs being covered by said cover and the remainder of the prongs being bendable and wherein said prongs include a tip and are tapered from the tip to a point between the tip and the end connected to the base;

c. a non-metallic sheath overcoating covering a substantial portion of each prong, said sheath being a tubular member elastically engaged onto said prongs and extending from a point proximate said tip and to said base and at least a portion thereof extending under said cover; and d. wherein the sheath, at least at its distal end, terminates with a concave end.

* * * * *